United States Patent [19]

Harvey

[11] Patent Number: 4,665,563

[45] Date of Patent: May 19, 1987

[54] RAIN JACKET

[76] Inventor: Marc Harvey, 18 St-Cyrille Street, Outremont, Quebec, Canada, H2V 1H8

[21] Appl. No.: 728,331

[22] Filed: Apr. 29, 1985

[30] Foreign Application Priority Data

May 14, 1984 [CA] Canada ..... 454263

[51] Int. Cl.[4] ..... A41D 1/02; A41D 3/04

[52] U.S. Cl. ..... 2/87; 2/108; 2/DIG. 1

[58] Field of Search ..... 2/DIG. 1, 87, 69, 82, 2/92, 108, 94

[56] References Cited

U.S. PATENT DOCUMENTS 4,408,356 10/1983 Abrams ..... 2/87

*Primary Examiner*—Louis K. Rimrodt
*Assistant Examiner*—Joseph S. Machuga
*Attorney, Agent, or Firm*—Schwartz, Jeffery, Schwaab, Mack, Blumenthal & Evans

[57] ABSTRACT

Rainproof jacket, particularly for riders, including a back panel having a ventilation window which runs over its major portion. A rain protection flap fully covers this ventilation opening. The upper edge of the flap is secured to the upper end of the back panel while the lower edge of the flap is releasably secured to the lower end of the back panel. The lateral edges of the flap are unattached, that is they remain free of the back panel and of the ventilation window so that air is allowed to freely circulate between the ventilation window and the rain protection flap.

5 Claims, 5 Drawing Figures

RAIN JACKET

The present invention relates to an article of clothing, more particularly to an improved rain jacket to protect the upper body and the head of the wearer, especially a cyclist, from getting wet while providing active ventilation.

In order to be comfortable, a rainproof jacket, particularly for cyclists or the like active people, must be well ventilated so as to prevent accumulation, inside the garment, of heat and water vapor produced by the wearer.

Almost all known waterproof garments are provided with some openings intended to insure a certain inside air renewal. The best waterproof jackets are also provided with special inside linings to prevent condensation. They may also be made out of vapour permeable waterproof fabric. Unfortunately these jackets tend to be heavier and more cumbersome than ordinary jackets made of coated nylon fabric. On the other hand, the openings provided are often closed by flaps which prevent the rain from getting in the garment. The surface of these openings and the pressures involved are always too small to insure a significant air circulation. The fact that the cyclists are moving through the air with a certain speed slightly enhances the air circulation through the garment, but the openings and their covering flaps are usually not designed to take full advantage of this dynamic effect.

Accordingly, it is an object of the present invention to provide a rainproof jacket, particularly for cyclists, ventilated through a very large opening, at the back, covered with a special flap which behaves as an air deflector as well as a rain screen. The air deflector is lifted off the ventilation opening when the rider moves and thus insures an important air circulation through the opening.

It is another object of the present invention to provide a rain jacket as described above, which is very light in weight and which may be conveniently rolled up in a small bundle when not in use.

Accordingly, the invention is herein broadly claimed as a rain jacket, particularly for riders, comprising: a back panel having a ventilation window running over at least a major portion thereof; a rain protection flap fully covering the ventilation opening; means securing an upper edge of the flap to an upper end of the back panel and means releasably securing a lower edge of the flap to a lower end of the back panel, and wherein lateral edges of the flap remain free of the back panel and the ventilation window whereby to allow air circulation between the ventilation window and the rain protection flap.

The rain jacket is preferably provided with a separate wide-brimmed hat which can be stored when not in use in a special pocket which is conveniently located on one of the arms of the jacket beyond the elbow.

The rain jacket is also preferably provided with a small attached flap which serves as an envelope for the garment when not in use.

The invention will be more clearly understood by the description that follows of a preferred embodiment, description having reference to the accompanying drawings, in which.

Figure 1:
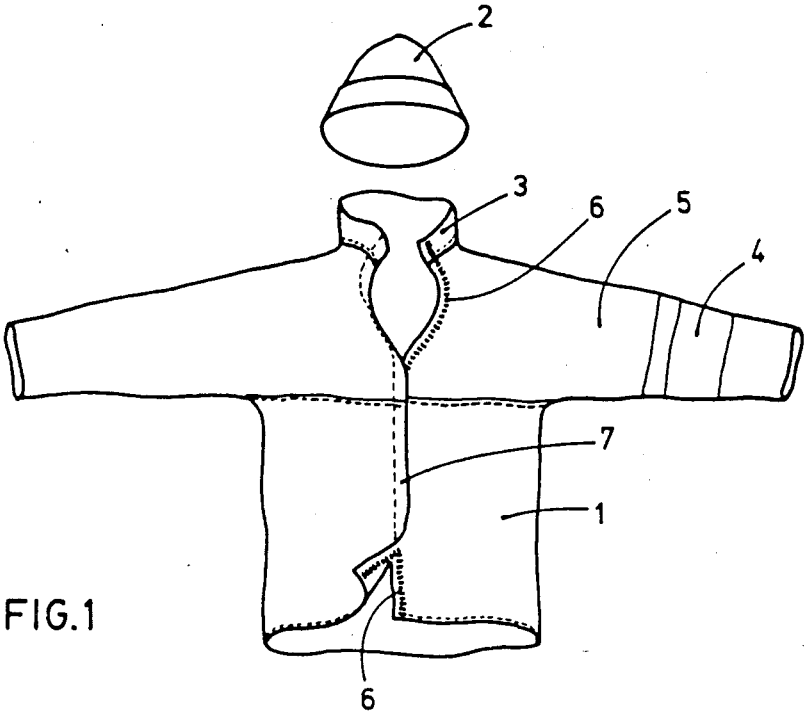
FIG. 1 is a front elevation view of a rain jacket made according to the invention and showing the hat out of its pocket.

The illustrated rain jacket 1 is made of light non extensible waterproof material and is adapted to protect the wearer's upper body B (FIG. 5) from the hip up to the shoulders while providing good ventilation. The garment further includes a wide-brimmed rainproof hat 2 adapted to protect the eyes of the wearer. It spreads down over the straight collar 3 of the jacket in order to securely protect the wearer's neck while providing for air circulation and maximum freedom of movement. When not in use, the hat can be stored in a special pocket 4 located for easy access such as being provided on the front face 5 of the left arm of the jacket.

The front panel of the garment is vertically slit as shown on FIG. 1. The slit can be closed by a known slide fastener 6 which is covered by a longitudinal fold 7 overlapping the slit, in the closed position of the slide fastener, to protect the fastener from rain.

Figure 2:
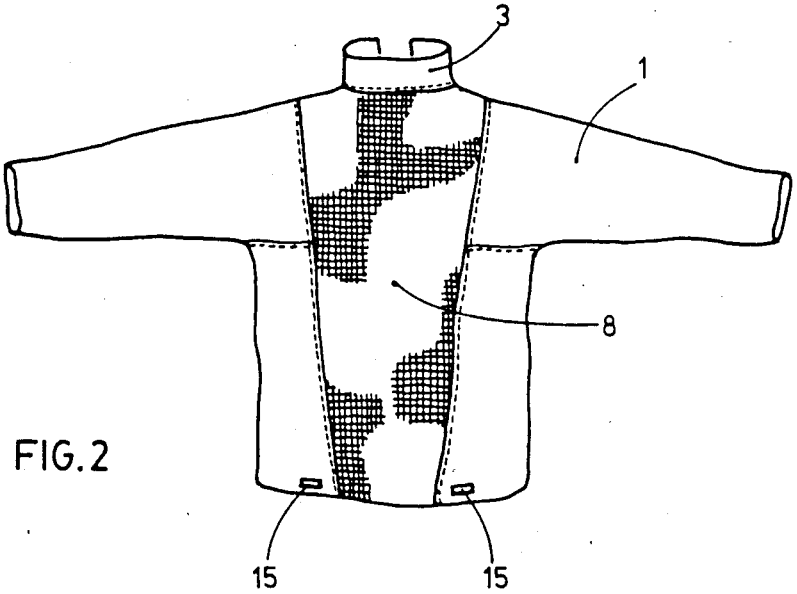
FIG. 2 is a rear elevation view of the jacket of FIG. 1 in which the different layers covering the ventilation window have been taken off.
Figure 3:
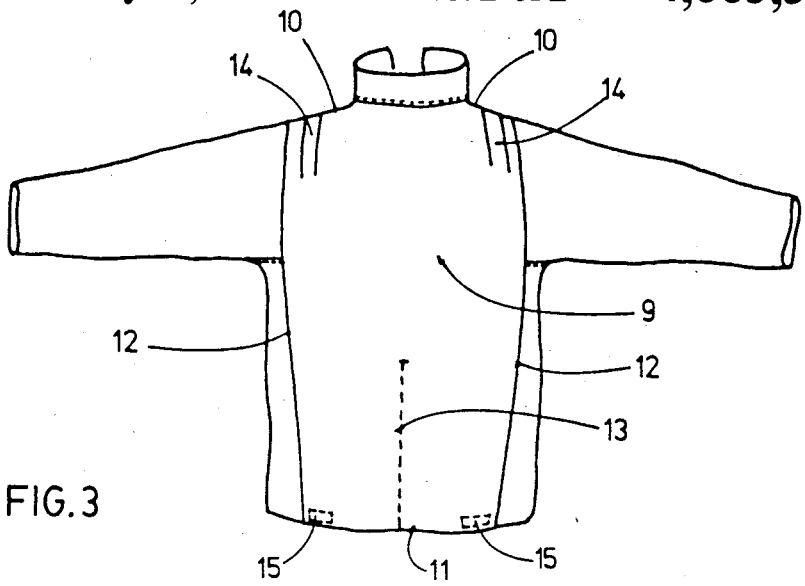
FIG. 3 is a rear elevation view as in FIG. 2, additionally showing the wind deflector rain screen covering the ventilation window.

The back panel of the jacket has an opening running along its full height, which opening is covered by a screen secured to the edges of the opening to form a ventilation opening 8, as can be seen in FIG. 2. In order to be protected from the rain, the aeration window 8 is fully covered by a flap 9 made of waterproof material of generally rectangular shape. The upper edge 10 and the lower edge 11 of the flap 9 are fixed to the back panel while the two lateral edges 12 remain entirely free along their full length. This type of assembly differs greatly from the common type where a shorter rainproof flat usually covers the upper back portion of the garment to which it is sealed along the upper and the two lateral edges, the lower horizontal edge alone being left open for air circulation. The present invention provides for much more air circulation, the free edges 12 of the protective flap 9 being much longer than in the common type. Moreover these free lateral edges actively enhance the ventilation when the cyclist rides because they tend to catch the air streaming on each side of the rider instead of floating passively in the eddies that form at the back of the rider. As soon as the rider gains speed, the protective flap 9 of the FIGS. 3 and 4 is inflated and lifted off the back panel thus providing maximum space for air circulation under the flap 9 and through the ventilation window 8.

According to a preferred embodiment of the present invention, the upper edge 10 of the flap 9 is slightly gathered and stitched at the top end of the jacket. The lower edge 11 is detachably fixed to the lower end of the jacket by a piece of Velcro tape 15 at each of the flap lower corners. This kind of releasable attachment prevents the flap 9 from being damaged should one of the free lateral edges 12 of the flap 9 accidentally get caught by any obstacle like a door handle, for example. The lower portion of the flap 9 is also stitched to the back ventilation window 8 by a vertical median seam 13 which prevents the inflated lower portion of the flap 9 from moving too far from the back panel where it would lose its efficiency as a rain screen.

Figure 5:
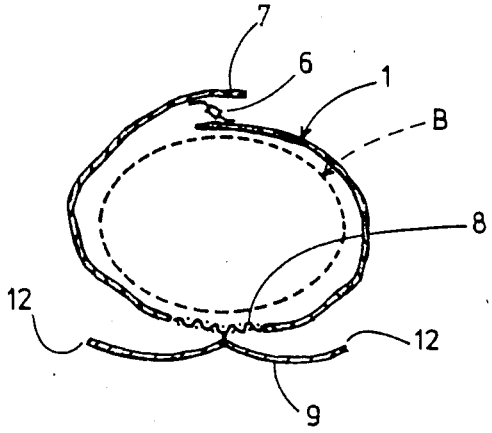
FIG. 5 is a cross-sectional view taken along line 5—5 of FIG. 4.

FIG. 5 is a cross-sectional view showing the flap 9 in an inflated condition and showing the median stitch on the ventilation window 8. The upper portion of the flap 9, when inflated, naturally tends to keep closer to the back panel than does the lower portion. This is the reason why, in accordance with a preferred embodiment of the invention, there is no need for median line of stitching on the upper portion of the flap 9. It is for the same reason that the upper edge 10 of the flap 9 is gathered before assembly: the pleats 14 provide for the extra material needed to increase as much as possible the space under the inflated upper portion of the flap 9.

Figure 4:
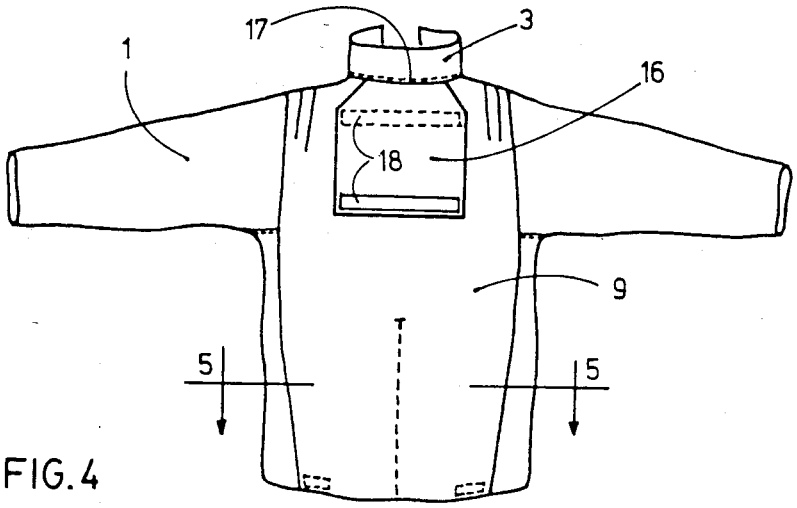
FIG. 4 is a rear elevation view of the jacket of FIG. 3, further showing the envelope flap over the rain screen flap.

As can be seen in FIG. 4, there may be provided a further small flap 16 over the main flap 9. This small flap 16, which may be a small band of flexible material of rectangular shape, preferably the same material as that of the jacket, is stitched to the jacket only along its upper edge 17 and is intended to serve for forming an envelope for the whole garment. With this small flap 16 spread out on a flat surface, the jacket is properly folded behind the spread flap. The whole is then tightly rolled up starting with the jacket, ending with the flap and forming a very compact cylindrical bundle. Two parallel transversal strips of velcro tape 18, fixed on opposite sides of the flap, are brought into contact when rolling up the flap 16 which thus becomes a closed cylindrical envelope containing the jacket.

In FIG. 2, it will be noted that the ventilation window 8 tapers slightly downwardly and that the two velcro strips 18 of the back panel are located immediately outside of the ventilation window 8.

I claim:

1. A rain jacket, particularly for riders, comprising: a back panel having an upper end, a lower end and a ventilation window running over substantially the full length thereof; a rain protection flap fully covering the ventilation window, said flap having an upper edge, a lower edge and a pair of lateral edges, means securing the upper edge of said flap to the upper end of said back panel; and means releasably securing the lower edge of said flap to the lower end of said back panel, said releasable securing means comprising separable securing strips positioned at the lower corners of said protection flap and on said lower end of said back panel, said strips being so located at the lower ends of said back panel as to cooperate with said strips of said flap, wherein the lateral edges of said flap remain free of said back panel and said ventilation window whereby to allow air circulation between said ventilation window and said rain protection flap, and said rain protection flap is stitched to said ventilation window along a stitch line extending between said lower and upper ends of said back panel, starting from said lower end and extending vertically to a point about mid-way between said ends.

2. A rain jacket as claimed in claim 1, wherein said ventilation window tapers down from said upper end of said back panel and said securing strips on said back panel are located outside of said ventilation window.

3. A rain jacket as claimed in claim 2, wherein said separable strips are of the VELCRO (T.M.) type.

4. A rainproof jacket as claimed in claim 2, wherein said ventilation window is formed by an opening extending between the upper and lower ends of said back panel and by a piece of screen material sewn along the lateral edges of said opening.

5. A rain jacket as claimed in claim 2, further comprising a generally rectangular band of flexible material secured solely along one of its edges at the upper end of said back panel and having spaced separable securing strips parallel to said one edge and on either side of said band.

* * * * *